US005461960A

United States Patent [19]

Marks et al.

[11] Patent Number: 5,461,960

[45] Date of Patent: Oct. 31, 1995

[54] DISPENSER

[75] Inventors: John W. G. Marks, Haslemere; Simon J. Yates, Portsmouth, both of United Kingdom

[73] Assignee: Chemring Limited, Portsmouth, United Kingdom

[21] Appl. No.: 184,688

[22] Filed: Jan. 21, 1994

[30] Foreign Application Priority Data

Jan. 23, 1993 [GB] United Kingdom ..... 9301321

[51] Int. Cl.[6] ..... F41F 3/065; F41F 7/00

[52] U.S. Cl. ..... 89/1.51

[58] Field of Search ..... 89/1.41, 1.51, 89/1.814, 1.816; 102/360, 352, 342, 345, 505

[56] References Cited

U.S. PATENT DOCUMENTS

| | | | |
|---|---|---|---|
| 3,208,350 | 9/1965 | Robinson | 89/1.41 |
| 3,708,563 | 1/1973 | Sells | 89/1.816 |
| 3,808,940 | 5/1974 | Schillreff et al. | 89/1.41 |
| 4,063,485 | 12/1977 | Carter et al. | 89/1.51 |
| 4,135,455 | 1/1979 | Wallace | 102/217 |
| 4,222,306 | 9/1980 | Maury | 89/1.41 |
| 4,307,665 | 12/1981 | Block et al. | 102/505 |
| 4,313,379 | 2/1982 | Wallace | 102/217 |
| 4,601,445 | 7/1986 | Duclos et al. | 89/1.51 |
| 4,679,483 | 7/1987 | Wranå | 89/1.51 |
| 4,936,785 | 6/1990 | Krug et al. | 439/75 |
| 5,058,481 | 10/1991 | Drummond et al. | 89/1.816 |
| 5,259,289 | 11/1993 | Peries et al. | 102/505 |
| 5,269,214 | 12/1993 | Badura et al. | 89/1.41 |

FOREIGN PATENT DOCUMENTS

| | | |
|---|---|---|
| 0072261 | 2/1983 | European Pat. Off. . |
| 0149380 | 7/1985 | European Pat. Off. . |
| 0246368A1 | 3/1986 | European Pat. Off. . |
| 0282394 | 9/1988 | European Pat. Off. . |
| 0442822 | 8/1991 | European Pat. Off. . |
| 2639154 | 5/1990 | France . |
| 2075155 | 3/1981 | United Kingdom . |
| 2138546 | 10/1984 | United Kingdom . |

*Primary Examiner*—Charles T. Jordan
*Attorney, Agent, or Firm*—Wood, Phillips, VanSanten, Clark & Mortimer

[57] ABSTRACT

A dispenser (1) for connection to the sequencer breech plate (5) of a dispensing system on an aircraft having a plurality of firing contacts, comprises a main body (2) subdivided into a plurality of cells (6). The number of cells (6) in the main body (2) is greater than the firing contacts on the breech plate (5) by payloads (7) being received directly by the main body as opposed to being separately constrained. An interface plate (4) is provided for electronically and mechanically connecting the dispenser (1) to the breech plate (5) matching the firing contacts to the breech plate with firing positions corresponding to the plurality of cells of the main body. In order to provide the electrical matching, pairs of contacts on a first part (12) of the interface plate (4) are interconnected by selector means (18) allowing a first firing signal to pass only to one contact of the pair and then allowing a second signal to pass to the other contact.

17 Claims, 5 Drawing Sheets

DISPENSER

This invention relates to a dispenser particularly for a plurality of charges of radar reflective chaff or for flares.

Chaff consists of fine electrically conducting filaments or foils which reflect radar waves and is used to confuse or distract weapon systems which rely on the use of radar. The chaff is dispensed and dispersed in a variety of different ways depending upon the effect to be created.

One form of dispensing system comprises a plurality of chaff cartridges—an example of which is shown in our published patent specification No. EP(UK)0246368—thirty of which are designed to be received in a dispenser releasably mounted to an electronic counter measure system on an aircraft and developed to provide maximum radar coverage with ease of handling. Each chaff cartridge typically consists of a plastics tubular body for retaining a plurality of chaff dipoles, one end of which is closed by a sealing end cap while the other end receives a pyrotechnic squib with a piston disposed intermediate the squib and the chaff dipoles. With thirty such cartridges located in the chaff dispenser, the chaff charges can be released sequentially on actuation of the respective squibs which cause a build-up in pressure behind the respective piston causing the piston to drive the chaff out of the one end of the chaff cartridge, the sealing end cap falling away. A similar chaff cartridge is also shown in United Kingdom published specification No. 2075155.

The existing chaff dispenser comprises a rectangular body subdivided into thirty openings for receiving the chaff cartridges. The dispenser is secured by four securing bolts and has a backplate fixed over the thirty loaded cartridges to prevent displacement during loading. The dispenser has an arming pin which marries up with fixed electrical contacts on the aircraft and the electrical contacts determine the order of fire, for example, ensuring that no adjacent cartridges are fired together to avoid a build-up of gas.

A problem with the existing arrangement is that we have now found that each chaff cartridge includes more chaff than is necessary. We also believe it would be a great advantage to be able to increase the number of chaff charges which would improve the performance of the dispenser and the operational effectiveness of the chaff dispersal. However, any new chaff dispenser has to interface with an existing sequencer breech plate on the aircraft designed to fire the chaff cartridges in a predetermined sequence.

An object of the invention is to provide an improved dispenser.

According to the present invention, a dispenser for dispensing payloads of chaff, flares or the like and for connection to sequencer means on an aircraft designed to fire the payloads in a predetermined sequence, the dispenser comprising a main body subdivided into a plurality of cells for receiving said payloads characterized in that, in use, the payloads are received directly by the main body whereby the main body may be disposable.

The dispenser is adapted to interface with a sequencer breech plate on an aircraft and preferably, though not essentially, has more payloads than existing dispensers. For example, in future, it may be possible to provide a modified breech plate. However, in the preferred arrangement, where the dispenser needs to interface with an existing breech plate, the dispenser further includes an interface plate for interposition between the breech plate and the main body whereby the firing contacts of the breech plate may be matched to the plurality of the payloads of the dispenser. Suitably the breech plate has thirty contacts and the interface plate converts the thirty contacts to sixty contacts.

Therefore, according to a preferred embodiment of the invention, a dispenser for connection to a sequencer breech plate of a dispensing system on an aircraft having a plurality of firing contacts, comprises a main body subdivided into a plurality of cells, said plurality of cells being greater than the plurality of firing contacts on the breech plate, and an interface plate for electronically and mechanically connecting the dispenser to the breech plate matching the firing contacts to the breech plate with firing positions corresponding to the plurality of cells of the main body. The main body comprises two identical half-mouldings secured together.

Suitably, the interface plate comprises first and second plates each including respective printed circuit boards, the first plate connecting with the main body and the second plate for connecting with the breech plate. The printed circuit board on the second plate may include thirty contacts for providing electrical contact with thirty firing connectors on a standard breech plate. The printed circuit board on the first plate suitably includes sixty contacts for connection with sixty cells in the main body.

In order to provide the electrical matching, pairs of contacts on the first plate are interconnected by selector means allowing a first firing signal to pass only to one contact of the pair and then allowing a second signal to pass to the other contact. Preferably, the selector means comprises thirty zener diodes, one for each pair of contacts. However, a single zener diode may be provided as an alternative.

The invention also includes a loaded dispenser including a chaff payload in each cell of the main body and a pyrotechnic squib for each payload. The firing face of the dispenser may be sealed by an aluminium foil.

According to another aspect of the invention, there is also provided an interface member for interfacing between the contacts of sequencer means on an aircraft and a dispenser having a different number of cells to the number of contacts, the interface member comprising electronic circuitry for matching the contacts of the sequencer means with the cells of the dispenser. Preferably the circuitry comprises respective printed circuit boards carried by first and second plates. The first and second plates may be of metallic material, in use, to provide rigidity in mechanical connection to the breech plate and a heat sink for heat generated by the firing of chaff or flare payloads located in the cells.

The invention will now be described by way of example with reference to the accompanying drawings in which.

Figure 1:
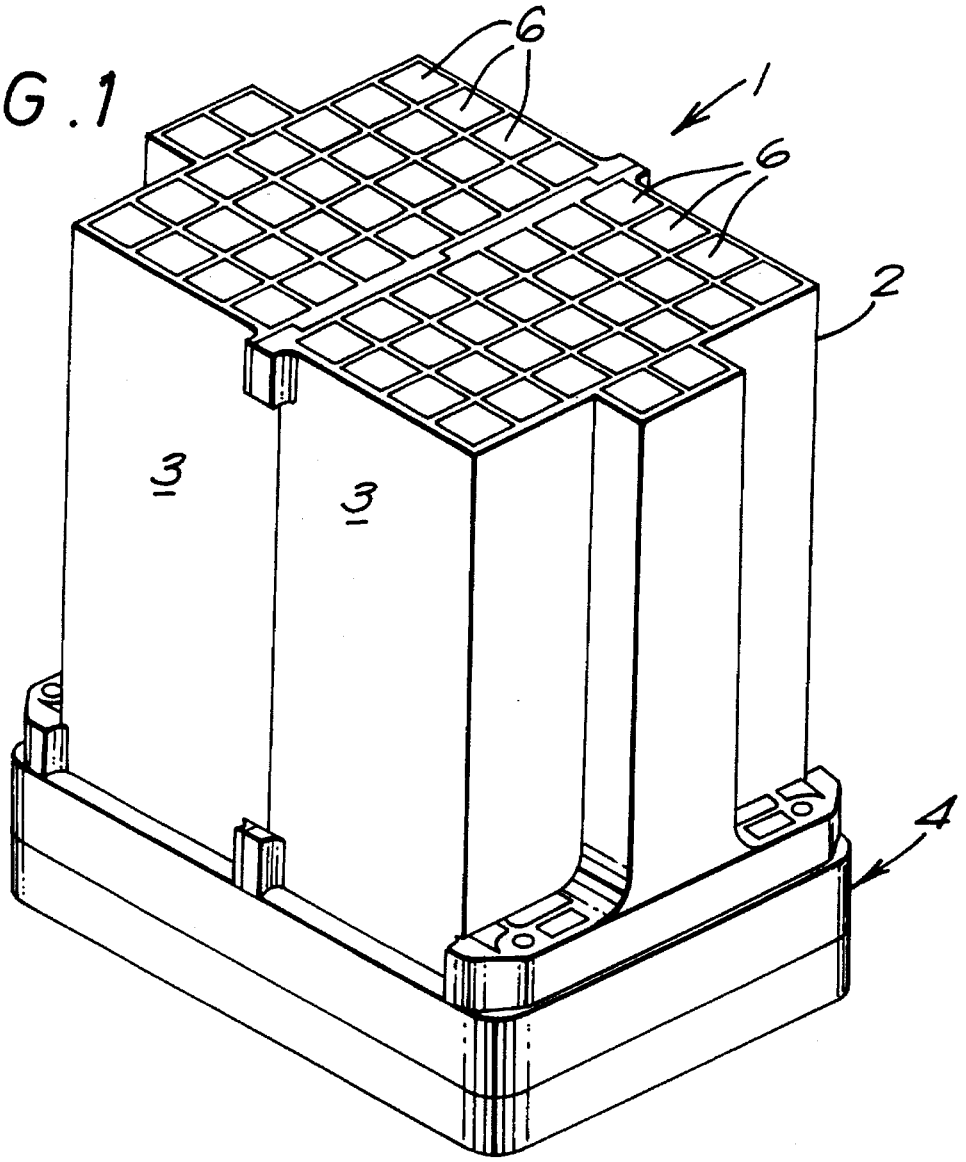
FIG. 1 is a perspective view of a chaff dispenser in accordance with the invention.

In the drawings, a chaff dispenser (1) comprises a main body (2) consisting of two identical half-mouldings (3), and an interface plate (4). The dispenser (1) interfaces with a breech plate (5) (FIG. 3) located within a mounting on an aircraft.

Figure 9:
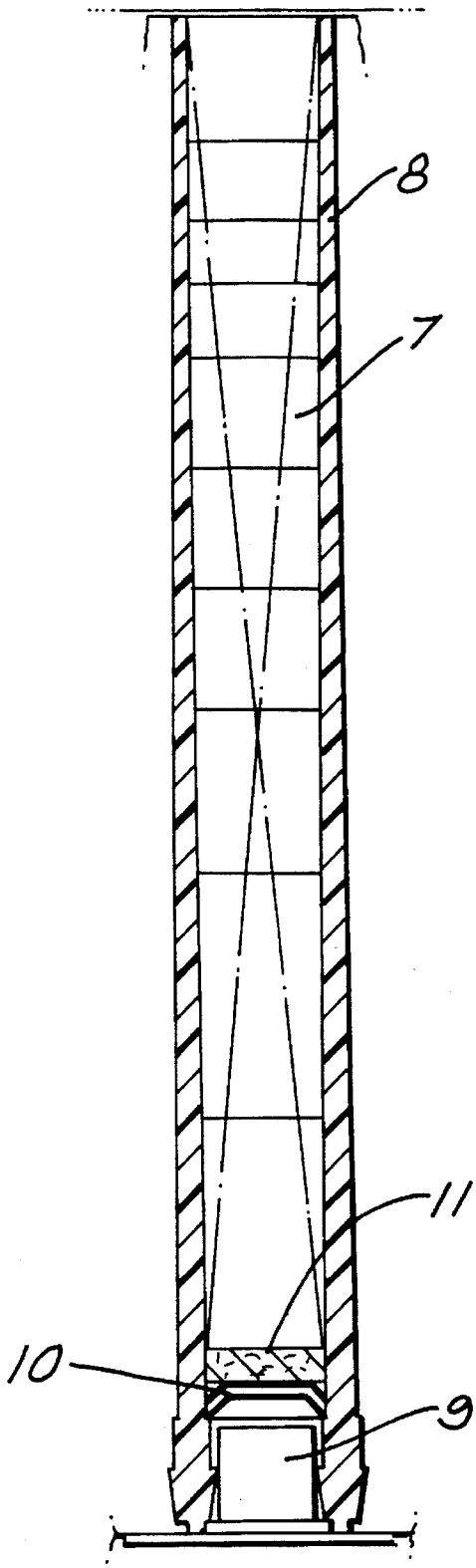

The main body (2) comprises sixty chaff cells (6) each of which is adapted to receive a respective chaff payload (7). The chaff cells (6) are separated by webs of plastics material (8) which are slightly tapered as shown in FIGS. 2 and 9 to facilitate injection moulding.

In the loaded condition (see FIG. 9) each chaff cell (6) includes a standard pyrotechnic squib (9) (BBU-35 squib) with a piston (10) and felt plug (11) positioned intermediate the squib (9) and the chaff payload (7). The piston (10) is a double piston with hinged side pieces to accommodate the taper of the webs (8) and prevent too much ejection gas from by-passing the piston as the chaff payload (7) is ejected out of the free end of the chaff cell (6).

Figure 5:
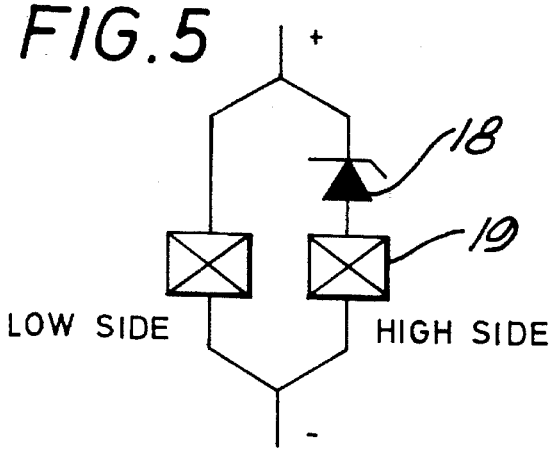
FIG. 5 is a diagrammatic circuit for converting a single electrical contact into a twin contact.
Figure 3:
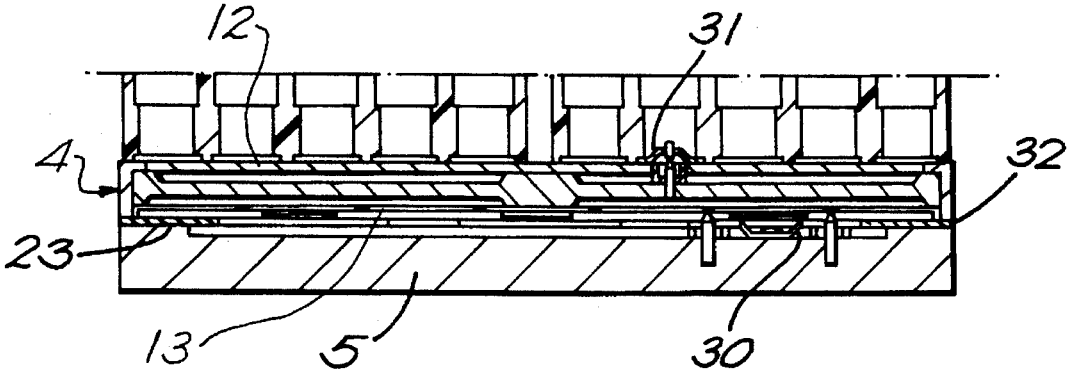
FIG. 3 is a partial sectional view showing the printed circuit board connections between the chaff payloads and the sequencer panel on the aircraft (not shown)
Figure 4:
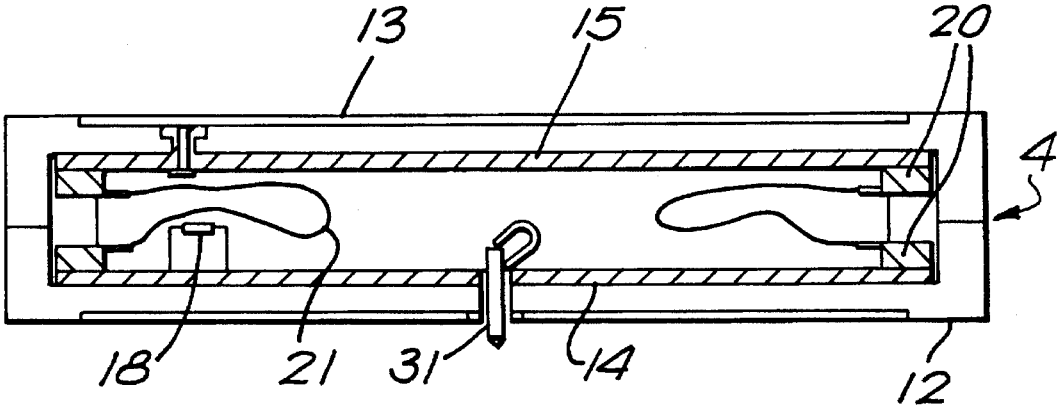
FIG. 4 is a diagrammatic cross-sectional view (inverted from FIGS. 2 and 3) of the preferred interface plate.
Figure 6:
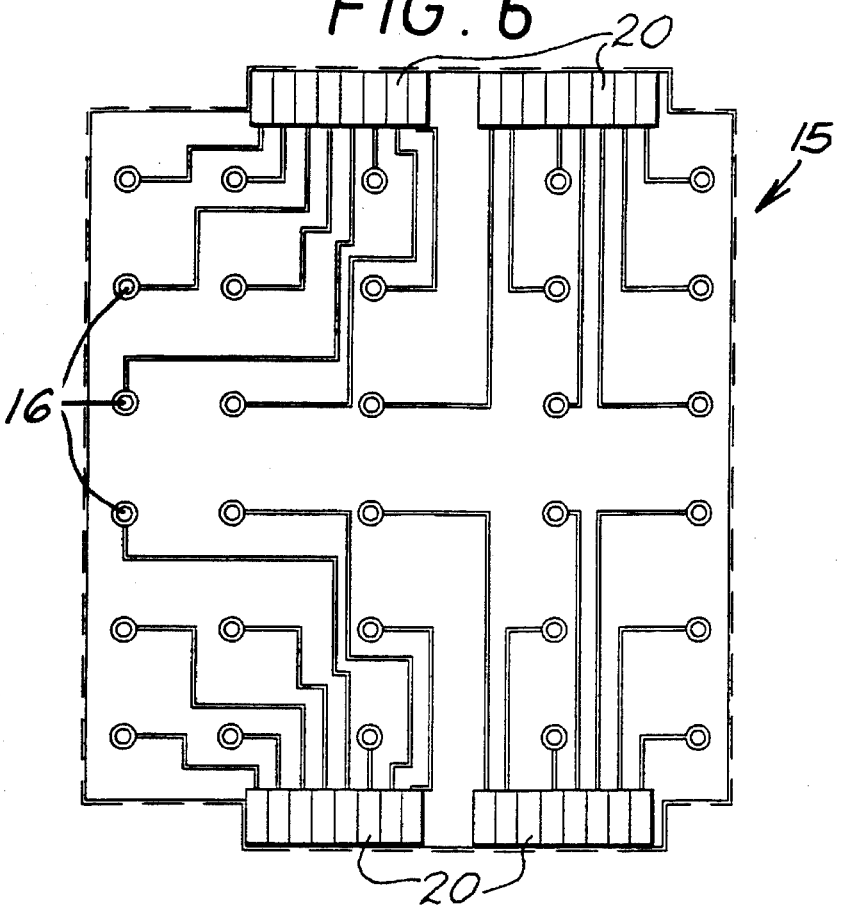
FIG. 6 is an example of the printed circuit board for interfacing with the conventional breech plate.

The interface plate (4), shown in side section in FIGS. 3 and 4, comprises an aluminium frame having a first plate (12) which interfaces with the main body (2) and a second plate (13) which interfaces with the breech plate (5). Each of the first and second plates (12,13) carry respective printed circuit boards (14,15). The PCB (15) as shown in FIG. 6 provides contacts (16) for the thirty firing spring and pin connectors (30) (FIG. 3) on the standard breech plate (5). The PCB (14) provides firing pin connections (17) for the sixty pyrotechnic squibs (9) disposed in the main body (2) by means of spring pin connectors (31) (FIG. 3). In order to convert the thirty contacts of the breech plate (5) to the sixty contacts at the squibs (9) of the main body (2), pairs of connections (17) on the PCB (14) are interconnected by the electrical circuits shown in FIG. 5. The circuit includes thirty 6 V zener diodes (18) which on the positive voltage side each connects to a first squib designated "high side" (19). This allows the firing of only one of the two squibs when first pulsed with an electronic firing signal and then allows firing of the other squib ("low side") on receipt of a second signal finding the circuit open on second pulsing. On the inside of the second PCB (15) electrical tracks distribute the firing currents received from connections (16) to four terminal blocks (20). The terminal blocks (20) on the second PCB (15) connect via ribbon cables (21) to four terminal blocks on the inside of the first PCB (14). As can be seen from FIG. 3, the second plate (13) receives a conventional breech cover (23).

Figure 2:
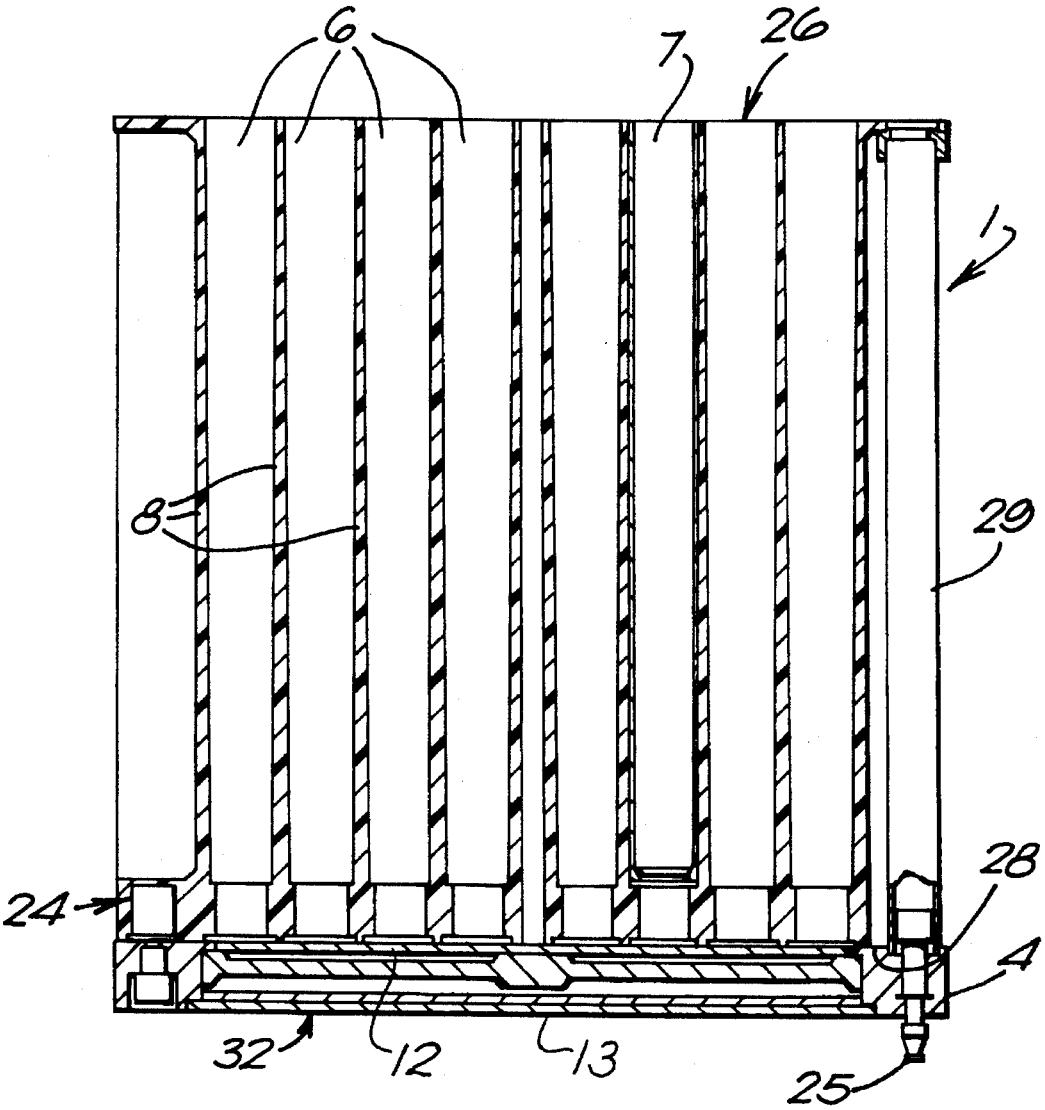
FIG. 2 is a cross-sectional view of the chaff dispenser of FIG. 1 with the left and right-hand sections taken at different positions.

Referring now to FIG. 2, the interface plate (4) is connected to the main body (2) by means of bolt connections (24) accessible from the breech face (32). The chaff dispenser (1), including the main body (2) and the interface plate (4), are connected to the breech plate (5) by means of four bolts (25) which are accessible from the firing face (26).

Figure 8:
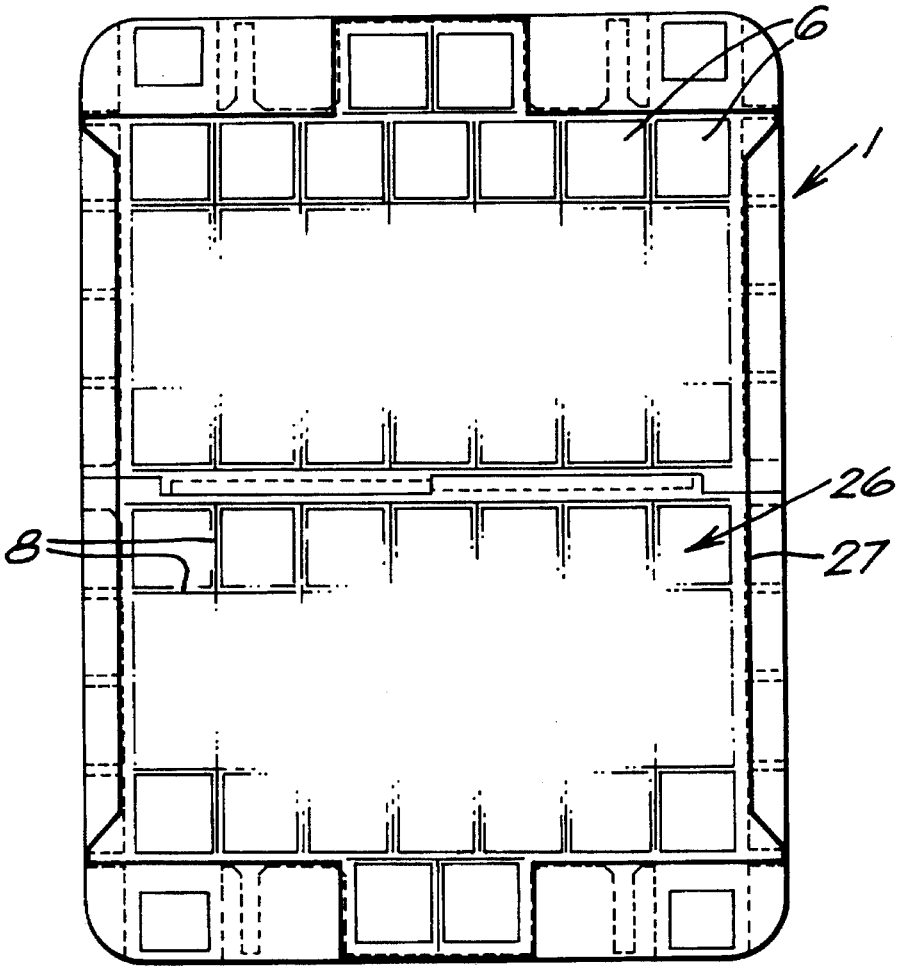
FIG. 8 is a top view of an assembled dispenser in accordance with the invention; and, FIG. 9 is a diagrammatic view of a chaff cell including a chaff payload.

As can be seen from FIG. 8, the firing face (26) is sealed by means of an aluminium foil sealing (27) which may either be scored about the end surfaces of the webs (8) or scored across each end opening. The foil (27) is bonded to the end of the main body by suitable adhesive.

In use, the main body (2) of the chaff dispenser (1) is loaded with chaff payloads (7) and then sealed by means of the aluminium foil (27) being secured by adhesive to the firing face (26). If long term storage is required then the main body may be protected by means of a polyester barrier bag or the like (not shown).

On wishing to load the chaff dispenser to an aircraft, the polyester barrier bag (if any) is removed and sixty firing squibs (9) are inserted by the operator in the lug face (28), one for each chaff cell (6). An interface plate (4) is then attached to the lug face (28) and secured by means of releasable bolts (24). The chaff dispenser (1) is then offered to the breech plate (5) and secured to the breech plate (5) on the aircraft by means of bolts (25) housed within lugs (29) moulded integrally with the main body (2) and accessible by means of a long shafted key (not shown).

Figure 7:
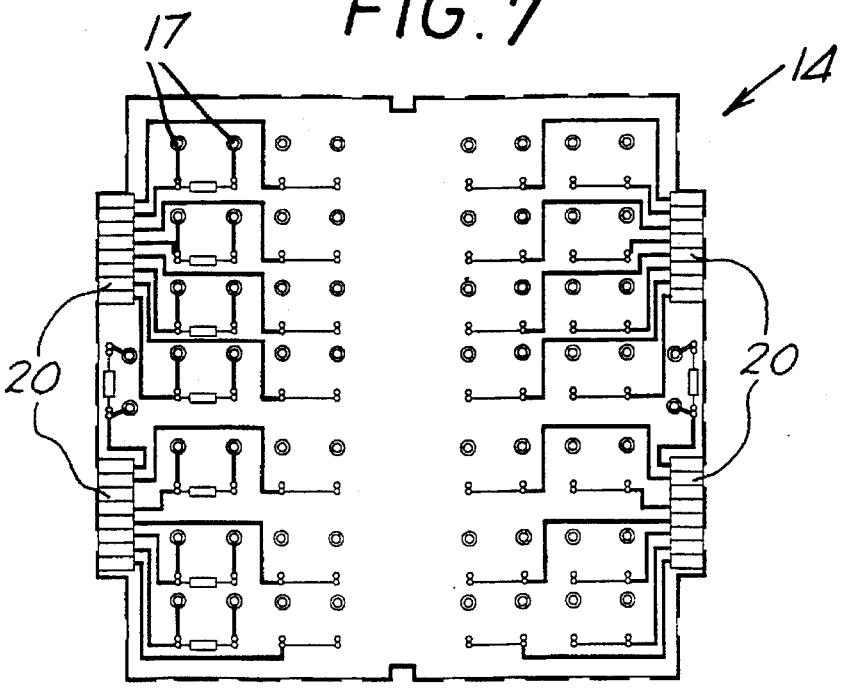
FIG. 7 is a second printed circuit board including the twin circuits of FIG. 5 for interfacing with the chaff payloads of the dispenser.

When it is desired to eject a chaff payload from the aircraft, electronic pulses are automatically transmitted to the breech plate (5) in a predetermined sequence. The thirty contacts on the breech plate (5) are converted to the sixty contacts on the interface plate (4) by means of the circuitry as particularly disclosed in FIGS. 5, 6 and 7.

The main body (2) is preferably an injection moulding and, being moulded in two identical half mouldings (3) a single mould may be used. The two mould halves (3) have mating surfaces which are suitably joined by ultrasonic welding, gluing with epoxy adhesive or by means of bolts. The interface plate (4) is suitably made of aluminium alloy and houses the printed circuit boards (14,15). This provides a strong base to accommodate the mechanical stresses of the connection of the main body to the breech plate (5) and also serves as a heat sink for the heat generated by the firing of the squibs (9). The breech cover (23) is preferably an aluminium alloy cover which is screwed to the second plate (13) of the interface plate (4). In order to prevent chaff flying back into the aircraft after ejection the lug face (28) is provided with a full flange to close the opening in the aircraft.

The chaff dispenser of the present invention has several advantages in that, whilst being connectable both electronically and mechanically with the breech plate located within the aircraft, it provides sixty payloads as opposed to the conventional thirty. It provides a main body (2) which may either be disposable or can be taken away for refurbishment allowing a quick turnround time and it avoids chaff being wasted by an unnecessary amount of chaff being dispensed in each discharge.

Although the present invention has been described with particular reference to the dispensing of chaff, the dispenser may also be used for the dispensing of flares, if desired.

Additionally, although the interface plate preferably comprises an aluminium frame, alternatively it may be an injection moulding.

We claim:

1. A dispenser for dispensing payloads and for connection to an aircraft including sequencer means having a plurality of firing contacts and being designed to fire the payloads in a predetermined sequence, the dispenser comprising a main body subdivided into a plurality of cells for receiving said payloads, the improvement comprising the dispenser further including an interface member for interposition between the sequencer means on an aircraft and the main body whereby firing contacts of the sequencer means may be matched to the plurality of the payloads of the dispenser, and wherein, in use, the payloads are received directly by the main body whereby the main body may be disposable.

2. A dispenser according to claim 1, wherein the main body comprises injection-moulded plastics material and the cells are separated by webs of plastics material which are tapered to facilitate moulding.

3. A dispenser according to claim 2, wherein the main body comprises two identical half mouldings joined together along mating surfaces.

4. A dispenser according to claim 1, for connection to an aircraft including sequencer means having thirty contacts wherein the interface member includes selector means for converting said thirty contacts associated with the sequencer means to sixty contacts associated with payloads received in the main body.

5. A loaded dispenser according to claim 1, including a chaff payload in each cell of the main body and a pyrotechnic squib for each payload.

6. A loaded dispenser according to claim 5, wherein a firing face of the dispenser remote from the interface member is sealed by an aluminium foil.

7. A dispenser according to claim 1, wherein said plurality of firing contacts of the sequencer means number less than said plurality of cells in the main body, said interface member for electronically and mechanically connecting the dispenser to the sequencer means on the aircraft matching the firing contacts of the sequencer means with firing positions corresponding to the plurality of cells of the main body.

8. A dispenser according to claim 1, wherein the interface member comprises first and second plates each including respective circuitry, the first plate connecting with the main body and the second plate for connecting with said sequencer means.

9. A dispenser according to claim 8, wherein the circuitry on the second plate may include thirty contacts for providing electrical contact with thirty firing connectors on said sequencer means.

10. A dispenser according to claim 8, wherein the circuitry on the first plate includes sixty contacts for connection with sixty cells in the main body.

11. A dispenser according to claim 8, wherein, in order to provide electrical matching, pairs of contacts on the first plate are interconnected by selector means allowing a first firing signal to pass only to one contact of the pair and then allowing a second signal to pass to the other contact.

12. A dispenser for connection to an aircraft including a dispensing system having a sequencer breech plate with a plurality of firing contacts, the dispenser comprising a main body subdivided into a plurality of cells, said plurality of cells being greater than the plurality of firing contacts on the breech plate, an interface member for electronically and mechanically connecting the dispenser to the breech plate matching the firing contacts to the breech plate with firing positions corresponding to the plurality of cells of the main body, the interface member comprising first and second plates each including respective circuitry, the first plate connecting with the main body and the second plate for connecting with the sequencer breech plate, and said circuitry on the second plate including thirty contacts for providing electrical contact with thirty firing connectors on said sequencer breech plate.

13. A loaded dispenser according to claim 12, including a chaff payload in each cell of the main body and a pyrotechnic squib for each payload.

14. A dispenser for connection to an aircraft including a dispensing system having a sequencer breech plate with a plurality of firing contacts, the dispenser comprising a main body subdivided into a plurality of cells, said plurality of cells being greater than the plurality of firing contacts on the breech plate, an interface member for electronically and mechanically connecting the dispenser to the breech plate matching the firing contacts to the breech plate with firing positions corresponding to the plurality of cells of the main body, the interface member comprises first and second plates each including respective circuitry, the first plate connecting with the main body and the second plate for connecting with the sequencer breech plate, the circuitry on the second plate including thirty contacts for providing electrical contact with thirty firing connectors on the sequencer breech plate, and the circuitry on the first plate including sixty contacts for connection with sixty cells in the main body.

15. A dispenser for connection to an aircraft including a dispensing system having a sequencer breech plate with a plurality of firing contacts, the dispenser comprising a main body subdivided into a plurality of cells, said plurality of cells being greater than the plurality of firing contacts on the breech plate, an interface member for electronically and mechanically connecting the dispenser to the sequencer breech plate matching the firing contacts to the sequencer breech plate with firing positions corresponding to the plurality of cells of the main body, the interface member comprising first and second plates each including respective circuitry, the first plate connecting with the main body and the second plate for connecting with the sequence breech plate, and the first plate including pairs of contacts interconnected by selector means allowing a first firing signal to pass only to one contact of the pair and then allowing a second signal to pass to the other contact whereby electrical matching between the sequencer breech plate and the plurality of cells of the main body is provided.

16. A dispenser according to claim 15, wherein the selector means comprises a plurality of zener diodes, one for each pair of contacts.

17. A loaded dispenser according to claim 15, including a chaff payload in each cell of the main body and a pyrotechnic squib for each payload.

* * * * *